US009257026B2

(12) United States Patent
Kalina

(10) Patent No.: US 9,257,026 B2
(45) Date of Patent: Feb. 9, 2016

(54) PERSONAL SELF-DEFENSE DEVICE

(71) Applicant: Loren D. Kalina, Mesa, AZ (US)

(72) Inventor: Loren D. Kalina, Mesa, AZ (US)

( * ) Notice: Subject to any disclaimer, the term of this patent is extended or adjusted under 35 U.S.C. 154(b) by 129 days.

(21) Appl. No.: 14/224,052

(22) Filed: Mar. 24, 2014

(65) Prior Publication Data

US 2015/0269820 A1 Sep. 24, 2015

(51) Int. Cl.

| | |
|---|---|
| ***G08B 15/00*** | (2006.01) |
| ***F41H 9/10*** | (2006.01) |
| ***F41B 15/02*** | (2006.01) |
| ***F41B 15/06*** | (2006.01) |

(52) U.S. Cl.
CPC ..... *G08B 15/00* (2013.01); *F41B 15/027* (2013.01); *F41B 15/06* (2013.01); *F41H 9/10* (2013.01)

(58) Field of Classification Search
CPC ..... F41H 9/10; G08B 15/00
USPC ..... 222/192, 78, 79; 340/384.1
See application file for complete search history.

(56) References Cited

U.S. PATENT DOCUMENTS

| | | | | | |
|---|---|---|---|---|---|
| 4,446,990 | A * | 5/1984 | Stevenson | F41H 9/10 | 222/398 |
| 5,086,377 | A * | 2/1992 | Roberts | F21V 33/0064 | 222/113 |
| 5,842,601 | A * | 12/1998 | Pierpoint | F41H 9/10 | 222/1 |
| 5,941,629 | A * | 8/1999 | Tuscher | F41H 9/10 | 222/113 |
| 2002/0162852 | A1* | 11/2002 | Cellini | F41H 9/10 | 222/1 |
| 2007/0238532 | A1* | 10/2007 | Stethem | F41B 15/04 | 463/47.2 |
| 2009/0038664 | A1* | 2/2009 | Juslin | A45B 3/00 | 135/66 |
| 2009/0201621 | A1* | 8/2009 | Abatemarco | A45B 3/04 | 361/232 |
| 2011/0275435 | A1* | 11/2011 | Torre | A63F 13/02 | 463/37 |

* cited by examiner

*Primary Examiner* — Donnell Long
(74) *Attorney, Agent, or Firm* — David O. Simmons

(57) ABSTRACT

A self-defense device includes a housing structure, a spray apparatus and a sound generating mechanism. The housing structure includes an interior space accessible though an opening within a first end portion thereof. The spray apparatus is attached to a first end portion of the housing structure. The spray apparatus allows a substance configured for impairing at least one of sight and respiratory function of a person to be selectively sprayed therefrom. The sound generating mechanism within the interior space of the housing structure. Actuation of the sound generating mechanism causes a sound recognizable as that of a firearm being mechanically charged to be created thereby.

7 Claims, 4 Drawing Sheets

PERSONAL SELF-DEFENSE DEVICE

FIELD OF THE DISCLOSURE

The disclosures made herein relate generally to personal self-defense devices and, more particularly, to a personal self-defense device that simulates the pumping sound (also referred to as racking) of a shotgun.

BACKGROUND

The realities surrounding the need for self-defense devices are well known. It is also well known that people want to feel safe in their personal space (e.g., at home). However, they often prefer to provide for their own safety through self-defense in a manner that does not involve an inherently lethal means of protection. Accordingly, a device that provides for such self-defense in a manner that is not specifically configured to inflict life threatening injuries and that is specifically configured to serve as a deterrent to being attacked or otherwise victimized is beneficial desirable and useful.

SUMMARY OF THE DISCLOSURE

Embodiments of the present invention are directed to a self-defense device. More specifically, embodiments of the present invention are directed to a self-defense device that is not specifically configured to inflict life threatening injuries and that is specifically configured to serve as a deterrent to being attacked or otherwise victimized. For example, a preferred embodiment of the present invention includes self-defense feature comprising a threatening sound, a self-defense feature comprising a disabling fluid dispenser, and a self-defense feature for visually conveying the capability of inflicting bodily harm.

In one embodiment of the present invention, a self-defense device comprises a housing structure and a sound generating mechanism. The housing structure includes two housing bodies. At least one of the housing bodies has an interior space accessible though an opening within a first end portion thereof. A first one of the housing bodies is slideably mounted within the interior space of a second one of the housing bodies through the opening at the first end portion thereof. The sound generating mechanism is within the interior space of at least the second one of the housing bodies and is connected to at least one of the housing bodies. The sound generating mechanism audibly simulates the sound of a firearm being mechanically charged when one of the housing bodies is slid with respect to the other one of the housing bodies.

In another embodiment of the present invention, a self-defense device comprises a housing structure, a spray apparatus and a sound generating mechanism. The housing structure includes an interior space accessible though an opening within a first end portion thereof. The spray apparatus is attached to a first end portion of the housing structure. The spray apparatus allows a substance configured for impairing at least one of sight and respiratory function of a person to be selectively sprayed therefrom. The sound generating mechanism within the interior space of the housing structure. Actuation of the sound generating mechanism causes a sound recognizable as that of a firearm being mechanically charged to be created thereby.

In another embodiment of the present invention, a self-defense device comprises a housing structure, a spray apparatus, a support structure, and a sound generating mechanism. The housing structure includes a first housing body and a second housing body. Each one of the housing bodies has an interior space accessible though an opening within a first end portion thereof. One of the housing bodies is slideably mounted within the interior space of the other one of the housing bodies through the opening at the first end portion thereof. The spray apparatus is attached to a second end portion of one of the housing bodies. The spray apparatus allows a substance configured for impairing at least one of sight and respiratory function of a person to be selectively sprayed therefrom. A support structure is attached to a second end portion of one of the housing bodies. The support structure is configured for supporting the housing structure in an upright position when the support structure is engaged with an underlying support surface. The sound generating mechanism is jointly within the interior space of each one of the housing bodies and is connected to each one of the housing bodies. The sound generating mechanism audibly simulates the sound of a shotgun being pumped when one of the housing bodies is slid longitudinally with respect to the other one of the housing bodies.

These and other objects, embodiments, advantages and/or distinctions of the present invention will become readily apparent upon further review of the following specification, associated drawings and appended claims.

DETAILED DESCRIPTION

Figure 1:
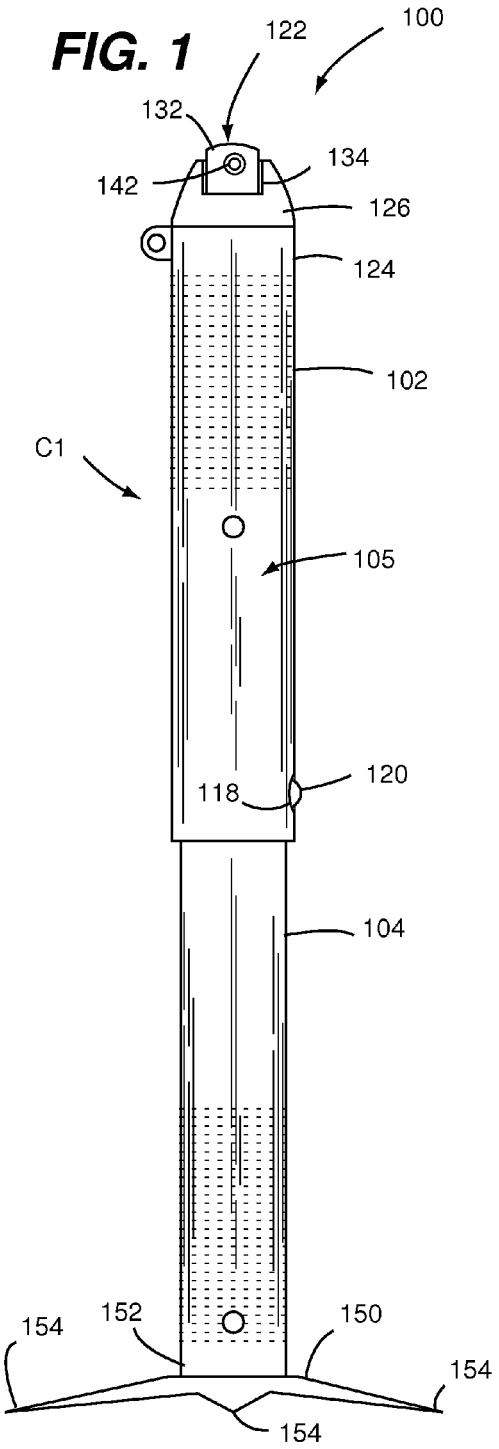
FIG. 1 is a side view of a self-defense device configured in accordance with an embodiment of the present invention with housing bodies thereof in a fully extended (e.g., locked) orientation.
Figure 3:
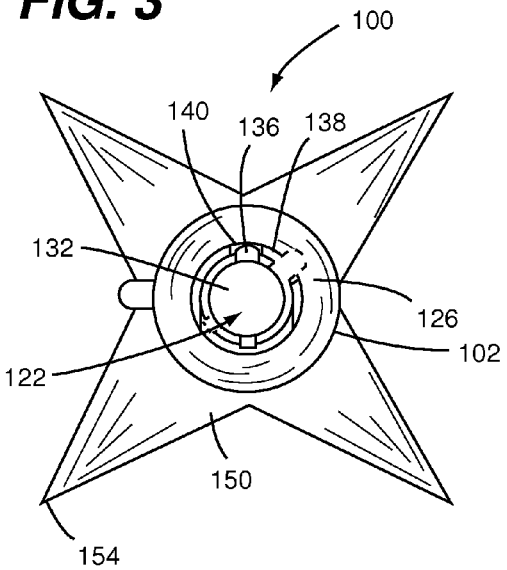
FIG. 3 is a top view of the self-defense device shown in FIG. 1.
Figure 4:
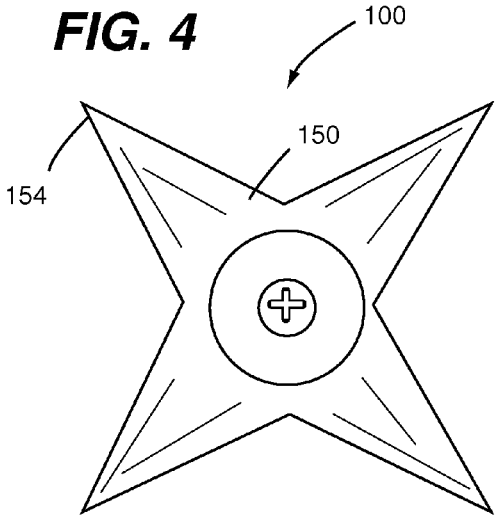
FIG. 4 is a bottom view of the self-defense device shown in FIG. 1
Figure 2:
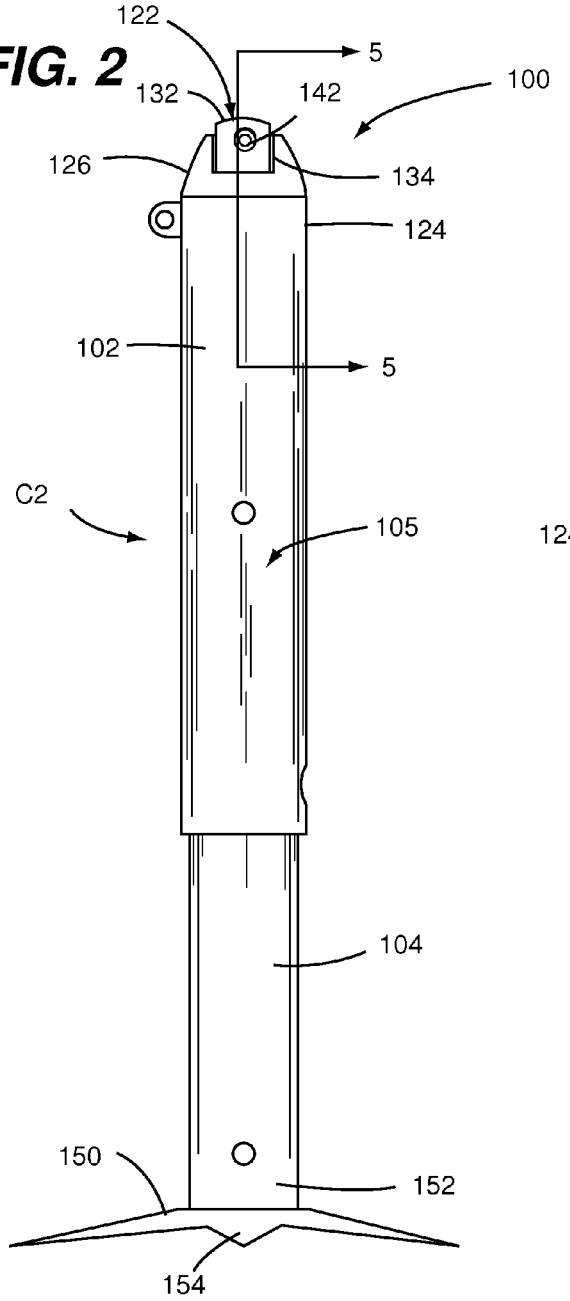
FIG. 2 is a side view of the self-defense device shown in FIG. 1 with housing bodies thereof in a displaced (e.g., compressed) orientation.

FIGS. 1-3 show various aspects of a self-defense device 100 configured in accordance with an embodiment of the present invention. As discussed below in greater detail, the self-defense device 100 includes a self-defense feature comprising a threatening sound, a self-defense feature comprising a disabling fluid dispenser, and a self-defense feature for visually conveying the capability of inflicting bodily harm. In this regard, the self-defense device 100 is not specifically configured to inflict life-threatening injuries and is specifically configured to serve as a deterrent to being attacked or otherwise victimized.

Referring to FIGS. 1-5, the self-defense device 100 includes having a first housing body 102 and a second housing body 104, which jointly define a housing structure 105. Each one of the housing bodies 102, 104 has a respective interior space 106, 108. The respective interior space 106, 108 of each one of the housing bodies 102, 104 is accessible though a respective opening 110, 112 within a respective first end portion 114, 116 thereof. Preferably, but not necessarily, at least the portion of the first housing body 102 and a second housing body 104 comprising the respective interior space 106, 108 is made from a metal material such as for example, steel or aluminum.

The second housing body 104 is slideably mounted within the interior space 106 of the first housing body 102. In this regard, the housing bodies 102, 104 can be translated longitudinally between a fully extended configuration C1 (FIG. 1) and a fully displaced configuration C2 (FIG. 2). The first and second housing bodies 102, 104 jointly define a release mechanism that secures the housing bodies 102, 104 in the fully extended configuration C1 (e.g., a hole 118 in the first housing body and a spring-biased ball 120 attached to the second housing body 104).

As shown in FIGS. 1-3 and 5, a spray apparatus 122 is mounted within (i.e., attached to) a second end portion 124 of the first housing body 102. A substance configured for impairing at least one of sight and respiratory function of a person (e.g., pepper-type spray, mace-type spray or the like) can be selectively sprayed from the spray apparatus 122. In this regard, the spray apparatus 122 serves as a self-defense feature comprising a disabling fluid dispenser. A cap 126 of the first housing body 102 secures a body 128 of the spray apparatus 122 within a cavity 130 of the first housing body 102. A head 132 of the spray apparatus 122 extends through an opening 134 in the cap 126.

Figure 5:
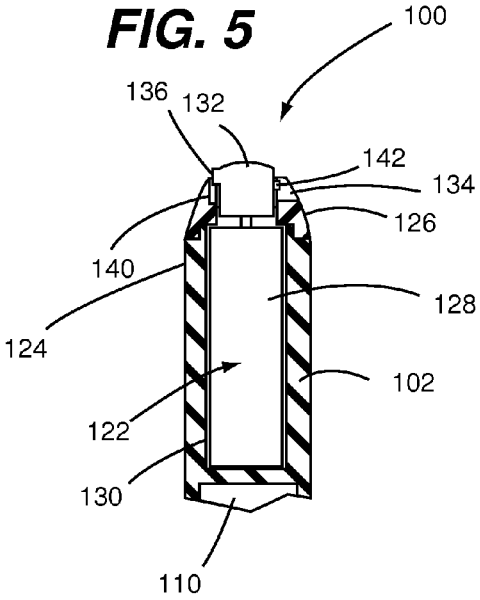
FIG. 5 is a cross-sectional view taken along the line 5-5 in FIG. 2.

As best shown in FIGS. 3 and 5, for safety, the head 132 of the spray apparatus 122 includes a protrusion 136 that resides within a recess 138 of the cap 126. When in a first rotational orientation with respect to the cap 126 (i.e., head 132 in solid lines in FIG. 1), the protrusion 136 is aligned with a slotted portion 140 of the recess 138 thereby allowing the cap 126 to be sufficiently depressed for causing the substance contained in the body 128 of the spray apparatus 122 to be dispensed (i.e., sprayed from a nozzle portion 142 of the head 132). When in a second rotational orientation with respect to the cap 126 (i.e., head 132 in dotted lines in FIG. 1), the protrusion 136 is not aligned with the slotted portion 140 of the recess 138 thereby inhibiting the cap 126 from being sufficiently depressed for causing the substance contained in the body 128 of the spray apparatus 122 to be dispensed.

In view of the disclosures made herein a skilled person will appreciate that the specific orientation of spray direction of a spay apparatus in accordance with embodiments of the present invention is not limited to any particular direction. For example, it is disclosed herein that the spray direction can be substantially perpendicular to a longitudinal centerline axis of the housing structure 105 (e.g., as shown). In other embodiments, the spray direction can be substantially parallel to a longitudinal centerline axis of the housing structure 105 (e.g., with an activation structure (e.g., button) on a side surface of one of the housing bodies 102, 104). Still further, it is disclosed herein that an activation structure of the spray apparatus can be located anywhere on either one of the housing bodies 102, 104)

As best shown in FIGS. 1-4, a support structure 150 is attached to a second end portion 152 of the second housing body 104. The support structure 150 is configured for supporting the housing structure 105 in an upright position when the support structure 150 is engaged with an underlying support surface. Preferably, but not necessarily, the support structure 150 is made from a metal material such as, for example, steel or aluminum. Furthermore, preferably, but not necessarily, the support structure includes a plurality of pointed, protruding edge portions 154 that server as a self-defense feature for visually conveying the capability of inflicting bodily harm.

A sound generating mechanism 160 is jointly located within the interior spaces 110, 112 of the housing bodies 102, 104. The sound generating mechanism 160 provides the functionality of audibly simulates the sound of a firearm being mechanically charged. As depicted, the sound generating mechanism 160 is a mechanical assembly that audibly simulates the sound of a shotgun being pumped (i.e., shell being loaded into the chamber, which is commonly characterized by the sound resembling "chuck-chuck") when one of the housing bodies is slid longitudinally with respect to the other one of the housing bodies (i.e., the second end portions of the housing bodies are brought closer together). In another embodiment, the sound generating mechanism 160 can be a mechanical assembly that audibly simulates the sound of a handgun or carbines being mechanically charged (i.e., cartridge being loaded into the chamber, which is commonly characterized by the sound resembling "click-click"). It is also disclosed herein that embodiments of the present invention can include a sound generating mechanism comprising an electronic unit that electronically generates and outputs a fixed or selectable sound (e.g., the sound of a shotgun being pumped, the sound of a handgun or carbines being mechanically charged, etc).

Figure 6:
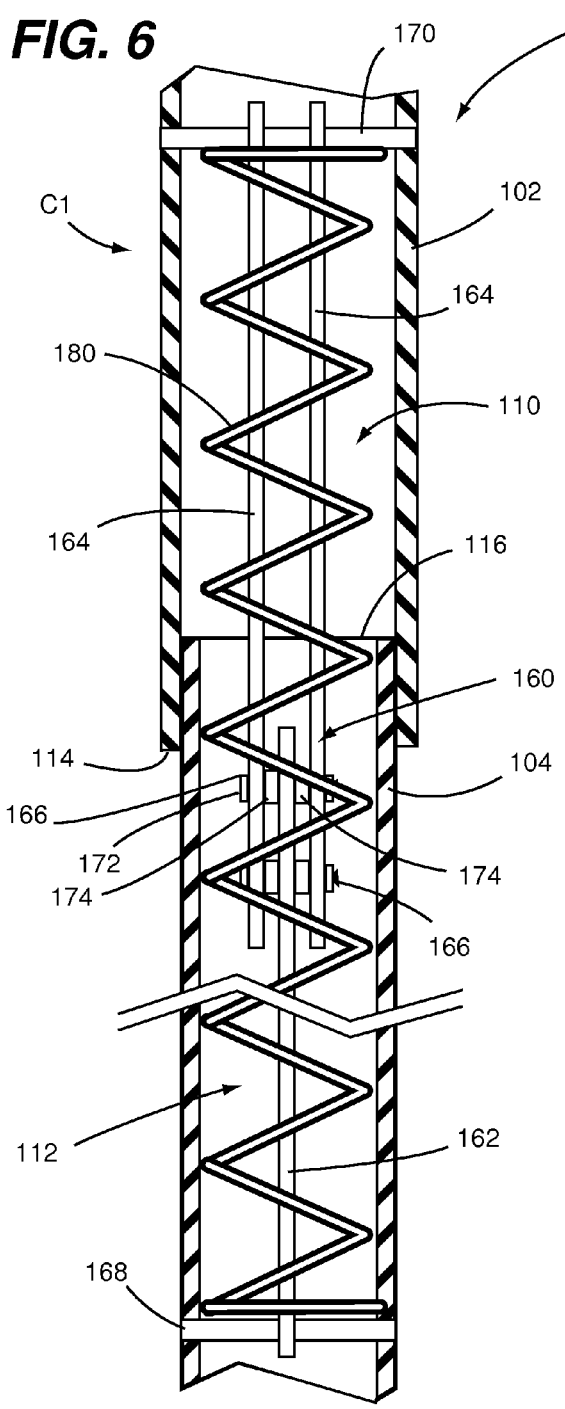
FIG. 6 is a fragmented cross-sectional view showing a housing structure portion and sound generator of the self-defense device shown in FIG. 1 in the fully extended orientation.
Figure 7:
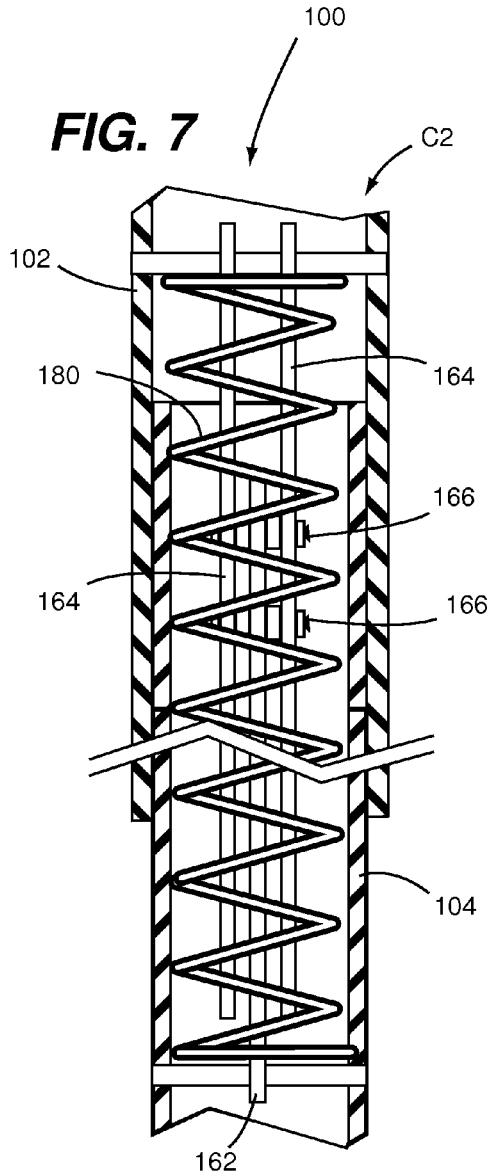
FIG. 7 is a fragmented cross-sectional view showing a housing structure portion and sound generator of the self-defense device shown in FIG. 1 in the displaced orientation.

Referring now to FIGS. 6 and 7, the sound generating mechanism 160 includes an elongated member of a first configuration (i.e., the first elongated member 162) and a set of elongated member of a second configuration (i.e., the second elongated members 164) on opposing sides of the first elongated member 162. A set of coupling assemblies 166 are fixedly attached to the first elongated member 162 and are slideably attached to the second elongated members 164. The first elongated member 162 is fixedly coupled to the second housing body 104 by a first retention member 168 and the second elongated members 164 are fixedly coupled to the first housing body 102 by a second retention member 170. In this manner, the elongated members 162, 164 are coupled between the housing bodies 102, 104 such that one of the housing bodies being longitudinally slid respect to the other one of the housing bodies causes a corresponding displacement of the first elongated member 162 relative to the second elongated members 164.

Figure 8:
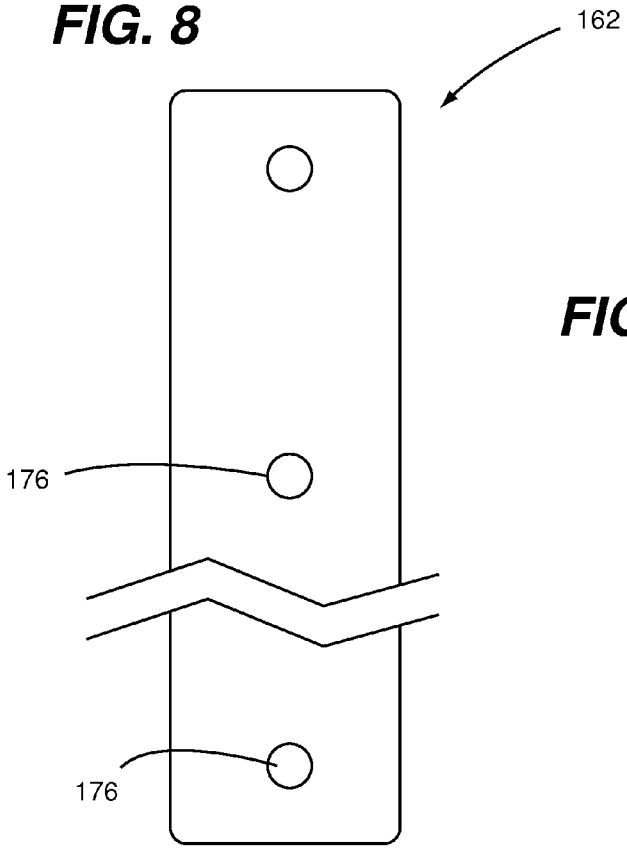
FIG. 8 is a side view showing an elongated member of a first configuration (i.e., a first elongated member) of a sound generating mechanism of the self-defense device shown in FIG. 1.
Figure 9:
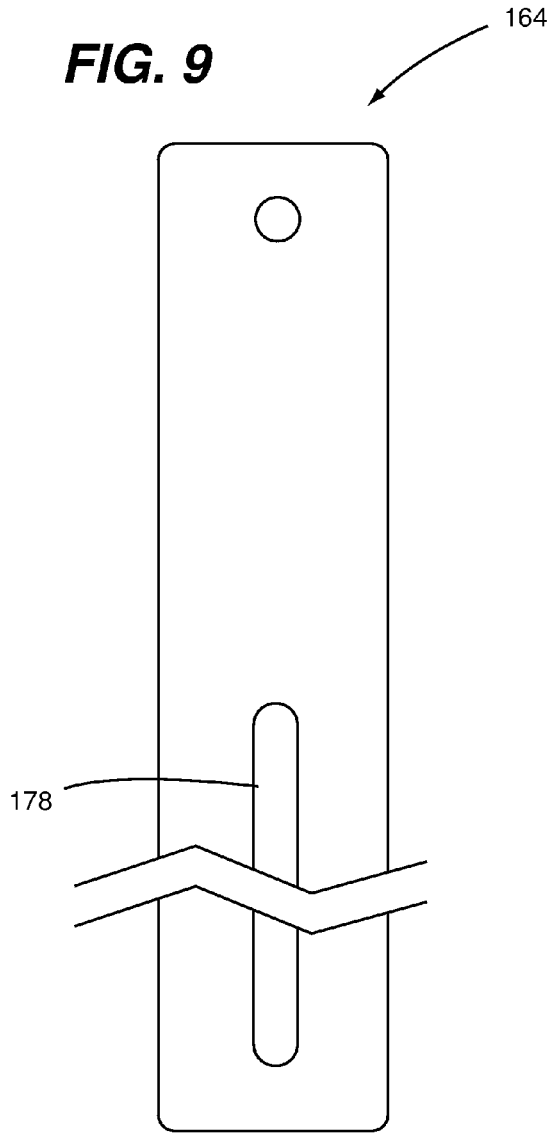
FIG. 9 is a side view showing an elongated member of a second configuration (i.e., a second elongated member) of the sound generating mechanism of the self-defense device shown in FIG. 1.

Still referring to FIGS. 6 and 7, each coupling assembly 166 includes an elongated fastener 172 and a plurality of spacers 174. A threaded fastener and a rivet are examples of the elongated fastener 172. One or more of the spacer 174 can be in the form of a washer (i.e., a thin spacer). Each threaded assembly has a spacer 174 between adjacent elongated members 162, 164 and has an elongated fastener 174 extending through a hole 176 in the first elongated member 162 (FIG. 8), a slot 178 in each one of the second elongated members 164 (FIG. 9) and through a hole in each one of the spacers 174. It is disclosed herein that each coupling assembly 166 can have a plurality of spacers between adjacent elongated members (e.g., a pair of washers with a spacer therebetween).

The slot 178 in each one of the second elongated members 164 is for allowing the housing bodies 102, 104 to be translated longitudinally between the fully extended configuration C1 and a compressed configuration C2 as disclosed above in reference to FIGS. 1 and 2 and as better shown in FIGS. 6 and 7. The slot 178 in the second elongated members 164 is disclosed herein to have an effective length that is substantially greater than an effective length of the holes 176 in the first elongated member 162. A spring 180 or other type of biasing member can be engaged between the retention members 168, 170 that secure the elongated members 162, 164 to the respective one of the housing bodies 102, 104.

It is disclosed herein that, in some embodiments of the sound generating mechanism 160, a plurality of sets of holes 176 and slots 178 in a side-by-side orientation (i.e., parallel rows) can be provided in each one of the elongated members 162, 164. Two or more coupling assemblies 166 would be in combination with each one of the sets of holes 176 and slots 178 (i.e., a plurality of side-by-side sets of coupling assemblies 166). An elongated stabilizer member can be disposed between adjacent sets of coupling assemblies 166 to limit side-to-side and/or fore and aft movement of the elongated members 162, 164 (i.e., keep the elongated members 162, 164 longitudinally aligned with each other). For example, an elongated piece of metal or polymeric material having a width dimension about the same as a distance between the spacers 174 of adjacent sets of coupling assemblies 166 can be disposed between adjacent sets of coupling assemblies 166.

To provide or enhance an intended sound simulation by the sound generating mechanism 160, it is preferred for certain elements of the sound generating mechanism 160 to be made from a solid metal material (e.g., steel or aluminum) and for there to be a metal-to-metal interface between certain elements of the sound generating mechanism 160. To this end, in one preferred embodiment of the sound generating mechanism 160 each one of the elongated members 162, 164 is made from a solid metal material, each one of the spacers 174 is made from a solid metal material, a metal-to-metal interface is provided between the spacers 174 and each one of the elongated members 162, 164 and a metal-to-metal interface is provided between the elongated members 162, 164 and the housing bodies 102, 104 (e.g., the retention members 168, 170 are made from a sold metal material).

Although the invention has been described with reference to several exemplary embodiments, it is understood that the words that have been used are words of description and illustration, rather than words of limitation. Changes may be made within the purview of the appended claims, as presently stated and as amended, without departing from the scope and spirit of the invention in all its aspects. Although the invention has been described with reference to particular means, materials and embodiments, the invention is not intended to be limited to the particulars disclosed; rather, the invention extends to all functionally equivalent technologies, structures, methods and uses such as are within the scope of the appended claims.

What is claimed is:

1. A self-defense device, comprising:

a housing structure having a first housing body and a second housing body, wherein each one of the housing bodies has an interior space accessible though an opening within a first end portion thereof and wherein one of the housing bodies is slideably mounted within the interior space of the other one of the housing bodies through the opening at the first end portion thereof;

a spray apparatus attached to a second end portion of one of the housing bodies, wherein the spray apparatus allows a substance configured for impairing at least one of sight and respiratory function of a person to be selectively sprayed therefrom;

a support structure attached to a second end portion of one of the housing bodies, wherein the support structure is configured for supporting the housing structure in an upright position when the support structure is engaged with an underlying support surface; and a sound generating mechanism jointly within the interior space of each one of the housing bodies and connected to each one of the housing bodies, wherein the sound generating mechanism audibly simulates the sound of a shotgun being pumped when one of the housing bodies is slid longitudinally with respect to the other one of the housing bodies.

2. The self-defense device of claim 1 wherein the spray apparatus is directly attached to a different one of the housing bodies than the support structure.

3. The self-defense device of claim 2 wherein the support structure includes a plurality of pointed, protruding edge portions.

4. The self-defense device of claim 1 wherein the sound generating mechanism includes:

a first elongated member;

a second elongated member;

a coupling assembly fixedly attached to the first elongated member and slideably attached to the second elongated member; and the elongated members are coupled between the housing bodies such that one of the housing bodies being longitudinally slid with respect to the other one of the housing bodies causes a corresponding displacement of the first elongated member relative to the second elongated member.

5. The self-defense device of claim 4 wherein:

the coupling assembly includes an elongated fastener and at least one spacer;

the at least one spacer is positioned between the first elongated member and the second elongated member;

the elongated fastener extends through the at least one spacer, a hole within the first elongated member and a hole within the second elongated member; and an effective length of the hole within the second elongated member is substantially greater than an effective length of the hole in the first elongated member.

6. The self-defense device of claim 5 wherein the elongated members are coupled between the housing bodies such that one of the housing bodies being longitudinally slid respect to the other one of the housing bodies causes a corresponding displacement of the first elongated member relative to the second elongated member.

7. The self-defense device of claim 6 wherein:

the interior space of each one of the housing bodies is within a tubular portion thereof;

the tubular portion of each one of the housing bodies is made from a solid metal material;

each one of the elongated members is made from a solid metal material;

the at least one spacer is made from a solid metal material;

a metal-to-metal interface is provided between the at least one spacer and each one of the elongated members; and a metal-to-metal interface is provided between the elongated members and the housing bodies.

* * * * *